US006890238B2

(12) United States Patent
Kessler

(10) Patent No.: US 6,890,238 B2
(45) **Date of Patent: *May 10, 2005**

(54) LIQUID CONTAINING HOOP WITH IMPROVED CONNECTOR

(75) Inventor: Brian Kessler, Los Angeles, CA (US)

(73) Assignee: Maui Toys, Inc., Youngstown, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/606,889

(22) Filed: Jun. 27, 2003

(65) Prior Publication Data

US 2004/0266313 A1 Dec. 30, 2004

(51) Int. Cl.[7] ..... A63H 1/00; A63H 23/08; A63B 23/02

(52) U.S. Cl. ..... 446/236; 446/267; 482/110

(58) Field of Search ..... 446/236, 267, 446/242; 472/133, 135; 482/110

(56) References Cited

U.S. PATENT DOCUMENTS

| | | | |
|---|---|---|---|
| 2,738,616 | A | 3/1956 | Windle |
| 2,979,860 | A | 4/1961 | Barta |
| 3,956,851 | A | 5/1976 | Tapinekis |
| 3,993,334 | A | 11/1976 | Fridman et al. |
| 4,090,324 | A | 5/1978 | Compton |
| 4,304,067 | A | 12/1981 | Petrosky |
| 4,986,535 | A | 1/1991 | Hull et al. |
| 5,629,068 | A | 5/1997 | Miekka et al. |
| 5,823,846 | A | 10/1998 | Arriola et al. |
| 5,895,309 | A | 4/1999 | Spector |
| 6,001,048 | A | 12/1999 | Taylor |
| 6,059,632 | A | 5/2000 | Sassak |
| 6,431,939 | B1 | 8/2002 | Roh et al. |
| 6,482,136 | B1 | 11/2002 | Kessler |
| 6,494,760 | B1 | 12/2002 | Kessler |

FOREIGN PATENT DOCUMENTS

| | | |
|---|---|---|
| FR | 1208935 | 2/1960 |
| FR | 1211877 | 3/1960 |

*Primary Examiner*—Derris H. Banks
*Assistant Examiner*—Faye Francis
(74) *Attorney, Agent, or Firm*—Browdy and Neimark, P.L.L.C.

(57) ABSTRACT

An exercise and/or play hoop, made of semi-rigid plastic tubing, is partially filed with water (30) to between ⅙ and ½ full, most preferably ¼ full. The water improves the dynamics of the hoop and makes it easier to keep the hoop elevated by gyration. The hoop is made of a length of hoop tube (10) bent into a circle. A coupling tube (20) is inserted where the ends (11, 12) abut, spanning the joint. The coupling tube includes a bore (25) through which the liquid flows circumferentially around inside the hoop, and past the joint. The coupling tube is formed of a hard and strong inner tube and a softer, somewhat compressible outer sheath which forms a seal with the inside of the hoop tube. A decorative, preferably iridescent sheet (18) may cover the hoop.

10 Claims, 2 Drawing Sheets

LIQUID CONTAINING HOOP WITH IMPROVED CONNECTOR

FIELD OF THE INVENTION

The present invention relates to play and/or exercise hoops of the type commonly known as HULA HOOPS.

DESCRIPTION OF THE RELATED ART

Play hoops of the HULA HOOP type are widely known. They are used for rolling and gyrating about the hips and other parts of the body. Such hoops are typically made from a length of plastic tubing by bending the length into a circle and joining the ends together.

Such hoops do not have any internal damping, which restricts their efficiency. To gyrate a conventional hoop about the hips requires considerable work because the needed rotational speed is quite high.

Another drawback of previous hoops is that they are too light. The conventional hoops can be made of heavier-walled plastic tubing, but this is expensive and makes for difficult bending into the required circular form.

One previous hoop designed by the present applicant had water contained therein in an attempt to solve these problems, but this earlier liquid-filled hoop was not successful. The water leaked out and the hoop did not function properly.

A play and/or exercise hoop is disclosed in my earlier U.S. Pat. No. 6,482,136, and in my other related U.S. Pat. No. 6,494,760, the contents of both of which are incorporated herein by reference. Such play and exercise hoops, which have achieved commercial success, are provided with internal inertia shifting. This is accomplished by partially filling the hollow tubular hoops with water. The trapped water increases the mass, provides internal damping of any motion (especially axial acceleration or deceleration), and leads to novel motions because of the shifting of the water inside.

The circular hoops of the aforementioned U.S. Pat. Nos. '136 and '760 allow the trapped water or liquid to freely circulate all the way around the hoops circumferentially; thus when the hoops are rotated about the body, the liquid remains in the part of the hoops opposite the part in contact with the body of the user, and the rolling motion of the hoops is smooth. The flow of the water around the circumference of the hoops must not be blocked if desirable dynamics are to be achieved.

The water filling of the hoops of my aforementioned two earlier U.S. patents makes easier the typical HULA-HOOP hip gyration in which the hoop remains elevated, and similar gyrations. This is because the water decreases the rotational speed needed in the hip motion, and slower rotation about the body is possible. Centrifugal force causes the water to shift as the circular hoop is rotated or gyrated about the hips, permitting a slower, easier and less tiring rotation.

A key factor in providing such a water-containing hoop is the provision of an adequate coupling between the two ends of the tube which form the hoop, so that liquid is able to flow substantially freely past the joint. While the constructions of my two earlier aforementioned U.S. patents are adequate and successful, the need exists for a still improved joint between two ends of the tube which form the hoop.

SUMMARY OF THE INVENTION

The present invention relates to an improvement over the hoop of my aforementioned U.S. patents, particularly as regards the joint between the two ends of the hoop tube.

Thus, according to the present invention, an improved and less expensive joint is provided by the use of an improved connector formed of two different materials, namely an inner hard and rigid material, and an outer softer material preferably having outwardly projecting ribs.

It is therefore an object of the present invention to provide an improved coupling in a liquid containing hoop construction, and thereby provide an improved liquid-containing hoop construction.

BRIEF DESCRIPTION OF THE DRAWING

The above and other objects in the nature and advantages of the present invention will become more apparent from the following detailed description of an embodiment thereof taken in conjunction with the drawings, wherein.

DETAILED DESCRIPTION OF THE PREFERRED EMBODIMENT

Figure 1:
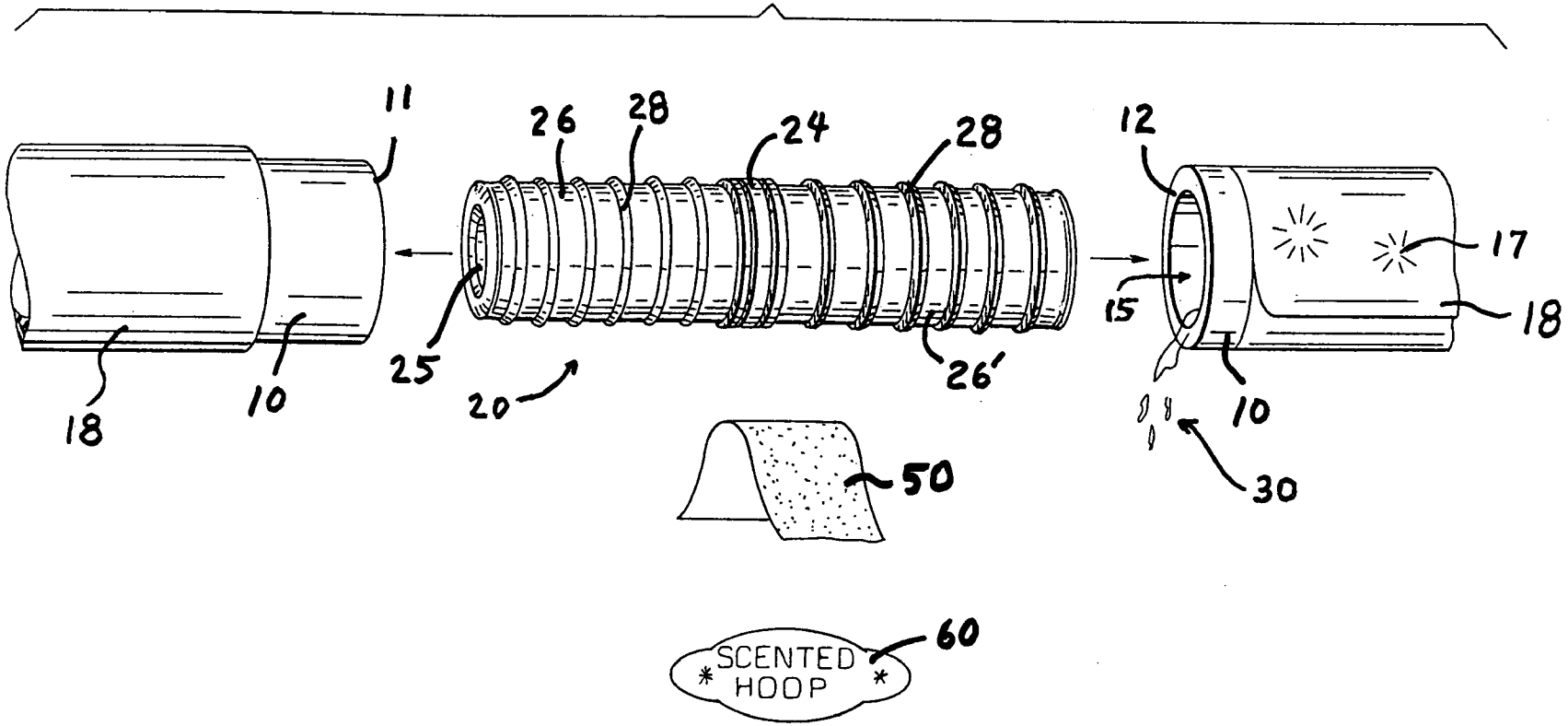
FIG. 1 is an exploded partial perspective view of the hoop of the present invention, also showing the construction of the improved connector.
Figure 2:
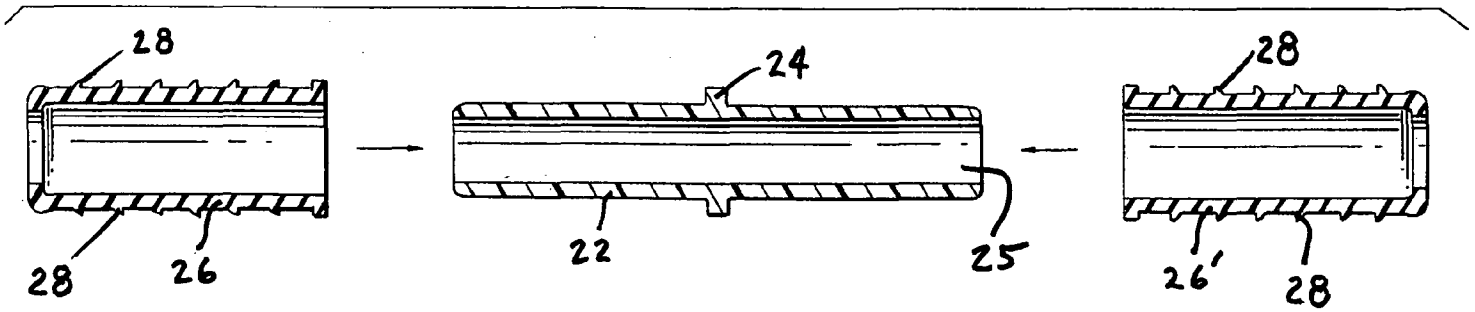
FIG. 2 is an exploded sectional view of the connector.
Figure 3:
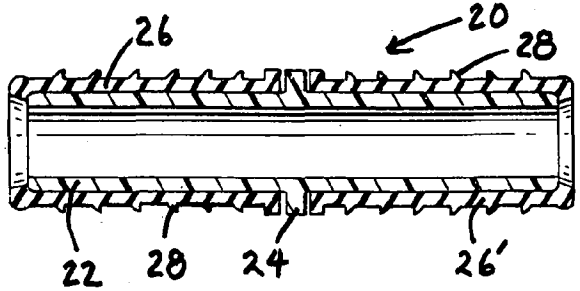
FIG. 3 is an assembled sectional view taken along the lines 3—3 of FIG. 4.
Figure 4:
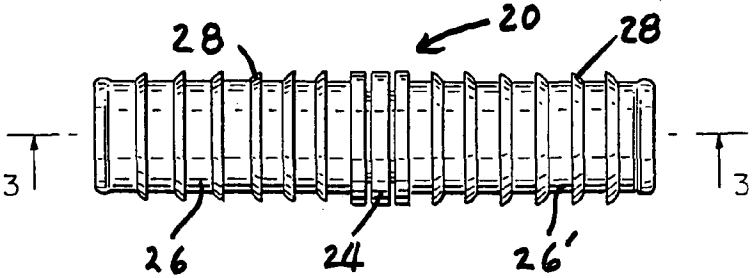
FIG. 4 is a side view of the assembled connector.

FIG. 1 shows two ends 11 and 12 of a circular hoop 10 shown in exploded view, separated to show the internal coupling tube 20, which is covered when the two ends 11 and 12 are butted together and the hoop is completed in the form of a hoop tube joint. The hoop tube 10 extends in a full circle (not shown) between its two ends 11 and 12, as is conventional in hoops.

The hoop tube 10 is semi-rigid and is preferably made of extruded polyethylene or polyethylene terephthalate glycol (PETG), the latter of which is a type of saturated (i.e. thermoplastic) polyester, the hoop tube 10 having a wall thickness for example of about 1 mm. Other plastics may be used for the hoop tube 10.

Preferably, the outside of the hoop tube 10 is covered with a decorative pattern such as iridescent sparkles 17, of the type employing diffraction rulings to cause scintillating colors. This decoration 17 may be applied in the form of a plastic film 18 wrapped around the hoop tube 10 and adhered to its outside surface. Such films having diffraction rulings may be produced by holographic printing. Other types of exterior decorations are also possible, but the iridescent-like effect produced by the diffraction rulings is particularly striking during rotation of the hoop about the hips, and therefore most desirable.

A liquid 30, preferably water, partially fills the interior space 15 of the hoop. Preferably the interior space 15 is partially filled with the liquid more than ⅙ full, and less than half full, by volume. Still more preferably, the hoop is between ⅙ and ⅖ full of liquid; and an optimum amount of liquid is approximately ¼ full. Less full than ⅙ provides an insufficient effect, and more than ½ overcomes the desirable inertial shifting effect.

The liquid 30 is preferably water, which may be treated to resist bacterial or fungal growth, to resist freezing, and/or the like. Preferably, the water 30 is scented with a perfume or the like so that the hoop emits a pleasant odor; or the pleasant scent-producing chemical may instead be incorporated into the film 18, if present, or within the wall of the hoop tube 10 itself.

Other-freely flowable materials may be used in place of the liquid 30, although water is preferable as indicated above. Other freely flowable materials can be routinely tested for suitability, with the objective being that the freely flowing material will flow sufficiently quickly to that part of the hoop opposite, i.e. roughly 180° from, the part of the hoop which is in contact with the user's body during rotation, and with the further objective that the freely flowable material will be able to pass quickly through the coupling tube described below.

To couple the two ends 11 and 12 of the hoop 10 together, a coupling tube or connector 20 is provided having an inner part 22 in the form of a hard, rigid tube of hard plastic, e.g. ABS, although other hard and sufficiently strong plastics can be used in place of ABS polymer, such other plastics being easily selected by those skilled in the present art or easily routinely tested for their suitability. The hard inner tube 22 desirably and preferably carries an optional circumferential ridge 24 at the approximately half way point between its two ends, one purpose of which is simply to ensure that the connector or coupling tube 20 has its halves respectively within the two ends 11 and 12 of the hoop tube 10.

Tightly engaging the exterior surface of the hard inner tube 22 is a sheath, preferably in two parts 26 and 26', formed of a softer material than the inner tube 22, most preferably a rubber material of Durometer SHORE A/D 75 to 90, most preferably of SHORE A/D 85, although other materials can be used and can be easily selected by those skilled in the present art, possibly after no more than routine testing. The sheaths 26 and 26' tightly frictionally engage with the exterior surface of the hard inner tube 22, and in the illustrated embodiment have ends which abut against the optional ridge 24.

The exterior surface of the outer sheath or sheaths 26 and 26' is provided with a series of outwardly projecting ribs 28, preferably extending circumferentially about sheath or sheaths, the ribs 28 being adapted to tightly engage with the interior surface of the respective ends of the hoop tube 10. As can be seen, the ribs 28 are desirably sloped so that the connector 20 can be jammed into the two ends of the hoop tube 10, and yet will strongly resist removal therefrom.

Consistent with my aforementioned earlier U.S. patents, it is an important and necessary feature of the present liquid-containing hoop that the liquid 30 is free to pass through the coupling tube 20, and so a large diameter through-bore 25 is provided in the hard inner tube 22. The bore 25 allows the water or other liquid to flow circumferentially around inside of the hoop past the joint, so that it does not pile up and ruin the dynamics of the finished hoop.

In one embodiment, the inner diameter of the hoop tube is 1.5 cm, and the diameter of the bore 25 of the connector tube 20 is 1.1 cm, and in general the bore 25 should have a cross-sectional area sufficiently great to provide sufficient pass-through of liquid past the connector tube 20, i.e. through the bore 25, especially in the case of hoop tubes having diameter bores no greater than 1.5 cm.

Other important aspects of the present invention are that the inner tube 22 of the connector 20 must be sufficiently hard to resist collapse and must be sufficiently strong to hold the hoop tube 10 in a circle without bending, while still permitting the bore 25 to have a sufficiently large diameter to allow the liquid to pass through without substantial inhibition.

In another example, for an inner tube 22 of about 13 mm outer diameter, a wall thickness of 2 mm has been found to be satisfactory, whereby the diameter of the bore 25 is 9 mm. With an outer sheath 26 having a wall thickness of about 1 mm, not counting the ribs 28, such a connector 20 is suitable for reliably and watertight connecting the ends of a hoop tube 10 having an inner diameter of about 14 mm. The sheaths 26 and 26' should be-somewhat compressible; they fill what otherwise would be a annular gap between the hard inner tube 22 and the interior of the hoop tube 10 and, after insertion, tightly grip the interior of the hoop tube 10, also acting as a seal to prevent any liquid escape from the interior of the hoop.

Once the connector 20 has been jammed into the two ends 11 and 12 of the hoop tube 10 to provide a substantially completed assembly, an optional label 60 may be applied if desired. Moreover, the top of the otherwise exposed ridge 24 can be optionally wrapped with tape 50, if desired, either underneath the label 60 or in place of the label 60, although neither the tape 50 nor the label 60 is essential.

The cross sectional shape of the hoop may be other than circular, e.g. octagonal, rectangular, ellipsoidal, etc, without departing from the invention. The diameters of both the hoop and the hoop tube may also vary.

The foregoing description of the specific embodiments will so fully reveal the general nature of the invention that other can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means and materials for carrying out various disclosed functions may take a variety of alternative forms without departing from the invention.

Thus the expressions "means to . . . " and "means for . . . " as may be found in the specification above and/or in the claims below, followed by a functional statement, are intended to define and cover whatever structural, physical, chemical or electrical element or structure may now or in the future exist which carries out the recited function, whether or not precisely equivalent to the embodiment or embodiments disclosed in the specification above; and it is intended that such expressions be given their broadest interpretation.

What is claimed is:

1. In a circular hoop for hip gyration comprising:

a hoop tube extending generally in a circle between two ends of the hoop tube, the ends substantially abutting at a hoop tube joint;

a flowable substance disposed inside the hoop tube;

a coupling tube disposed inside the two ends of the hoop tube and spanning the joint, the coupling tube including a bore through which the flowable substance is freely flowable circumferentially in the hoop past the joint; and a seal preventing the flowable substance from leaking between the coupling tube and hoop tube and through the hoop tube joint, the improvement wherein said coupling tube comprises an inner tube made of a strong and hard plastic covered with a sheath of softer, compressable material, and wherein said seal also comprises said sheath.

2. The hoop of claim 1 wherein said sheath is provided with at least one outwardly projecting rib.

3. The hoop of claim 1 wherein said sheath is provided with a plurality of outwardly projecting ribs.

4. The hoop of claim 3 wherein said plurality of ribs extend circumferentially about said sheath.

5. The hoop of claim 1 wherein said sheath comprises two parts, said two parts comprising a first sheath part and a second sheath part each extending approximately one-half the length of said inner tube.

6. The hoop of claim 5 wherein said inner tube comprises an outwardly extending ridge at a position approximately one-half the length thereof, said ridge separating said first sheath part from said second sheath part.

7. The circular hoop of claim 1, wherein said flowable substance is a liquid which fills approximately between ⅙ and ½ of an interior space of said hoop.

8. The hoop according to claim 7, wherein the liquid fills approximately between ⅙ and ⅖ of the interior space of the hoop.

9. The hoop according to claim 7, wherein the liquid fills approximately ¼ of the interior space of the hoop.

10. The hoop according to claim 1, comprising a decorative film covering on the hoop tube, said film being printed with diffraction rulings to provide an iridescent-like appearance.

* * * * *